US008594541B2

(12) United States Patent
Stelter et al.

(10) Patent No.: US 8,594,541 B2
(45) **Date of Patent: *Nov. 26, 2013**

(54) METHOD FOR TRANSFERRING DEVELOPER

(75) Inventors: Eric C. Stelter, Lexington, KY (US); Rodney R. Bucks, Webster, NY (US); Matthias H. Regelsberger, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 203 days.

This patent is subject to a terminal disclaimer.

(21) Appl. No.: 13/278,248

(22) Filed: Oct. 21, 2011

(65) Prior Publication Data

US 2013/0101316 A1 Apr. 25, 2013

(51) Int. Cl.
*G03G 15/09* (2006.01)

(52) U.S. Cl.
USPC ..... 399/277

(58) Field of Classification Search
USPC ..... 399/267, 272, 277
See application file for complete search history.

(56) References Cited

U.S. PATENT DOCUMENTS

| | | | | |
|---|---|---|---|---|
| 4,246,867 | A * | 1/1981 | Hudson | 399/269 |
| 6,061,541 | A * | 5/2000 | Bessette | 399/277 |
| 7,212,772 | B2 | 5/2007 | Kasiske | |
| 7,324,240 | B2 | 1/2008 | Ng | |
| 7,468,820 | B2 | 12/2008 | Ng | |
| 7,687,213 | B2 | 3/2010 | Lobo et al. | |
| 7,835,671 | B2 * | 11/2010 | Suzuki | 399/254 |
| 2008/0159786 | A1 | 7/2008 | Tombs et al. | |

* cited by examiner

*Primary Examiner* — David Gray
*Assistant Examiner* — Gregory H Curran
(74) *Attorney, Agent, or Firm* — Nelson Adrian Blish

(57) ABSTRACT

A method for transferring developer (14) to a development roller (11) in an electrophotographic printing process includes feeding developer from a first channel (12) to the development roller; releasing developer from the development roller to a second channel (15); and wherein a strength of a pickup field of a feed magnet (50) in the development roller increases in a direction of developer flow in the first channel.

10 Claims, 7 Drawing Sheets

METHOD FOR TRANSFERRING DEVELOPER

CROSS REFERENCE TO RELATED APPLICATIONS

Reference is made to commonly-assigned U.S. patent application Ser. No. 13/278,241 (now U.S. Publication No. 2013/0101315), filed Oct. 21, 2011, entitled DEVELOPMENT ROLLER WITH INCREASING MAGNETIC FIELD, by Stelter et al.; the disclosure of which is incorporated herein.

FIELD OF THE INVENTION

The present invention relates to electrostatography, including electrography and electrophotography, and more particularly, to a development system with multiple augers for an electrophotographic printer.

BACKGROUND OF THE INVENTION

The three channel development system used in electrophotographic printers has a development roller that moves developer containing toner into proximity with a primary imaging member, usually a photoconductor. The first channel contains a feed auger, a second channel contains a second auger, a third channel contains at least a third auger, and possibly a fourth auger. The primary imaging member is used for forming an electrostatic image. The developer used in development systems of this type contains magnetic particles and marking particles. The marking particles are removed from the development system to form an image on the primary imaging member.

The flow of developer through the three channel development system is such that developer is fed from the third channel to a first end of the feed auger in the first channel. As the developer travels longitudinally down the length of the feed auger, a portion of the developer is fed transversely from the feed auger to the development roller to produce a layer of developer on the development roller. The remainder of developer in the first channel continues to travel longitudinally down the length of the feed auger.

To produce a uniform image, the layer of developer on the development roller should be uniform along its length. The developer that is fed to the development roller moves over the development roller and is not returned to the feed auger. Instead it drops into the second auger in the second channel. Consequently, the volume of developer in the first channel decreases along the length of the first channel in the direction of developer flow along the first channel.

Developer moves longitudinally in the same direction in both the first channel and the second channel, from the first end of the augers to the second end, which is at the rear of the development system. At the rear of the development system, the developer collected by the second channel and the remaining developer in the first channel are both dropped into the third channel. It is also at this point that replenishment marking particles may be added to the developer to replace the marking particles that have been applied to the primary imaging member. The developer is moved longitudinally along the third channel by the third auger, or possibly by a third and forth auger acting together, toward the first end of the feed auger. The developer that has traveled the length of the third channel is fed to the first end of the feed auger in the first channel, so that the developer is cycled continuously from the first channel to the development roller, from the first and second channels to the third channel, and from the third channel to the first channel while the development system is running.

In comparison, two channel development system designs often have the characteristic that developer that has travelled over the development roller is dropped back into the channel from which it was fed to the development roller. Some of this developer will have had marking particles removed by the image. In other words, the concentration of marking particles in the developer is reduced as the developer is used for image development, returned to the feed auger, and subsequently travels down the feed auger of a two channel development system. As the toner concentration decreases, the developed mass and image density also decrease undesirably.

An advantage of the three channel design compared to a two channel design is that the marking particle concentration is maintained down the length of the first channel. However, the volume of developer in the first channel does not remain constant down its length, usually resulting in more developer on the development roller near the first end of the feed auger, where there is a relatively large volume of developer in the first channel. Near the second end of the feed auger, where there is a relatively small volume of developer, less developer is transferred to the development roller.

It is advantageous to have a constant mass flow of developer at any point along the entire length of the development roller as well as having a constant marking particle concentration in the developer that is presented to the primary imaging member via the development roller. Specifically, it is advantageous to have a means of maintaining the developer feed to the development roller despite the reduction in developer volume down the length of the first channel.

SUMMARY OF THE INVENTION

Briefly, according to one aspect of the present invention, a method for transferring developer to a development roller in an electrophotographic printing process includes feeding developer from a first channel to the development roller; releasing developer from the development roller to a second channel; and wherein a strength of a pickup field of a feed magnet in the development roller increases in a direction of developer flow in the first channel.

The invention and its objects and advantages will become more apparent in the detailed description of the preferred embodiment presented below.

DETAILED DESCRIPTION OF THE INVENTION

The present invention will be directed in particular to elements forming part of, or in cooperation more directly with the apparatus in accordance with the present invention. It is to be understood that elements not specifically shown or described may take various forms well known to those skilled in the art.

Figure 1:
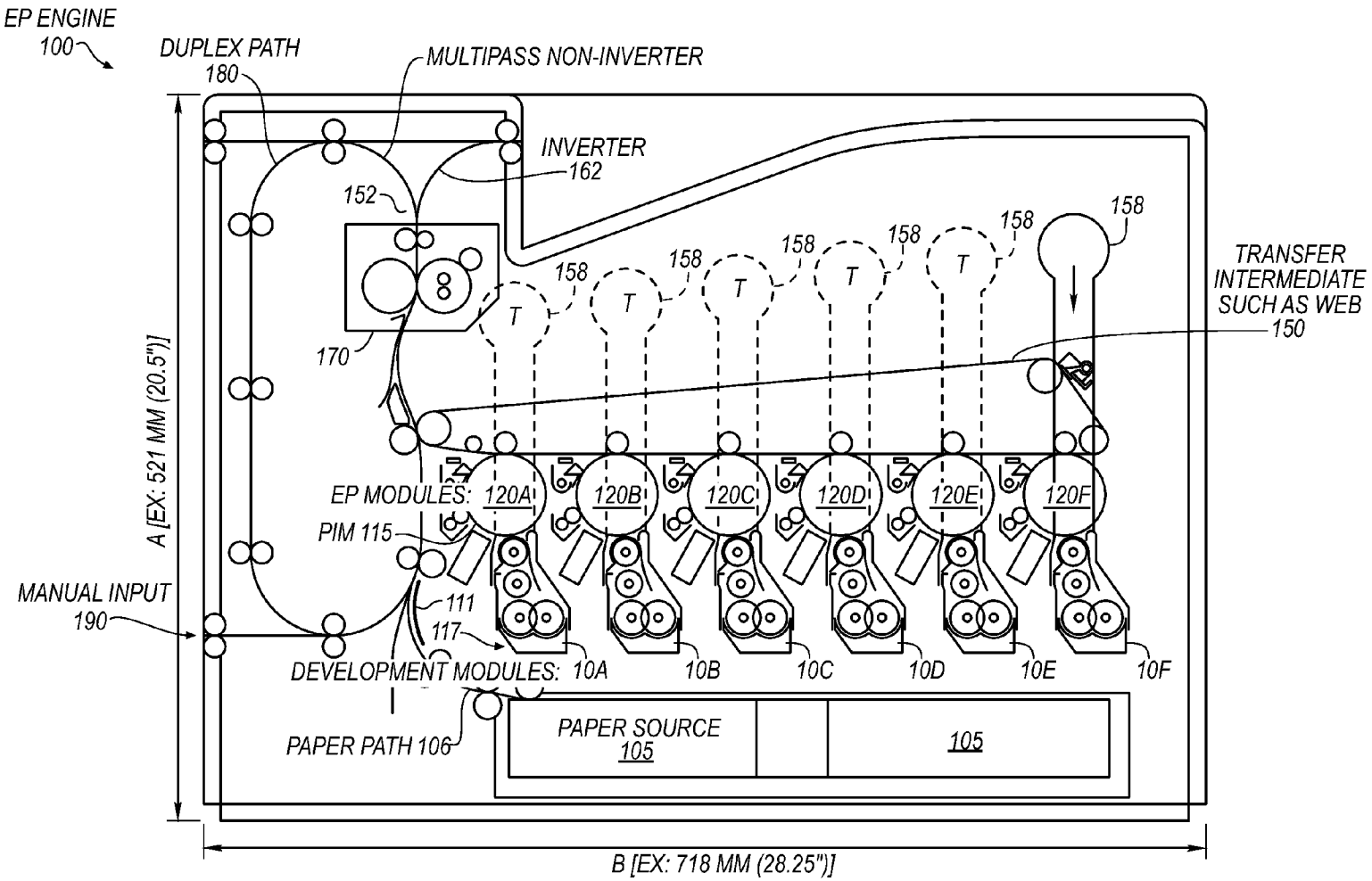
FIG. 1 is a cross-sectional view of an electrophotographic printer.

FIG. 1 shows an electrophotographic (EP) engine 100 or printer, often referred to as a tandem print engine including EP modules (120A, 120B, 120C, 120D, 120E, and 120F), wherein each contains a single primary imaging member 115 and a single development system (10A, 10B, 10C, 10D, 10E, and 10F) to print on receiver 111. The EP printer is shown having dimensions of A×B which, in one example, are 521×718 mm or less.

Development stations 10A-10D would typically contain marking particles that are typically used in most color prints. For example, marking particles of the subtractive primary colors cyan, magenta, yellow, and black would typically be contained in four of these development stations, and have typical optical densities such that a monolayer coverage (i.e. sufficient application of marking particles such that a microscopic examination would reveal a layer of marking particles covering between 60% and 100% of a primary imaging member) would have a transmission density in the primarily absorbed light color, as measured using a device such as an X-Rite Densitometer with Status A filters of between 0.6 and 1.0).

The additional development systems can be used to print specialty marking particles that are commonly used for many applications, selectively determined by a control element. An individual operating or owning (hereafter referred to as the operator) the EP engine could control the control element and this effectively determines which specialty marking particles would print. For example, a full-color image can be made using marking particles that function as ink containing typical cyan, magenta, yellow, and black subtractive primary colorants such as pigment particles or dyes.

The marking particles are contained in a development system that develops an electrostatic latent image and is in proximity to a cylindrical primary imaging member or a frame of a primary imaging member in the form of a continuous web. Additional marking particles corresponding to specialty toners or inks are contained in one of a plurality of development systems, any one of which can be brought into proximity with a primary imaging member bearing an electrostatic latent image and convert that electrostatic latent image into a visible image. For example, the electrophotographic engine shown in FIG. 1 contains six print modules. Four of the modules would each contain a single development system containing marking particles of one of the four subtractive primary colors.

The fifth and sixth EP modules 120E and 120F are shown with development systems, each containing marking particles having the function of a distinct specialty ink that can convert an electrostatic latent image into a visible image with only that specific specialty ink. For example, if clear toner is commonly used as a marking particle by a particular EP engine, the fifth development system 10E could contain clear toner. Alternatively, other marking particles that would be commonly used throughout a variety of jobs can be contained in the fifth EP module. The sixth EP module 120F is also capable of selectively printing a specialty marking particle. Images produced with specialty marking particles include transparent, raised print, MICR magnetic characters, specialty colors and metallic toners as well as other images that are not produced with the basic color marking particles.

Another example is white toner as a specialty toner. The first development system, 10A, may contain white toner. In this example, the white toner would be the last marking particle added to the toner deposit on the intermediate transfer member (ITM) 150. Upon transfer to the receiver 111, the white toner would be on the bottom of the toner stack against the paper and allow the formation of a subtractive colorant image on a colored paper by building the image on top of an image-wise deposit of the white toner. Development systems 10B, 10C, 10D, and 10E could contain marking particles with the typical subtractive colorants and 10F could contain a second specialty toner such as clear.

Development systems suitable for use in this invention include dry development systems containing two component developers such as those containing both marking particles and magnetic carrier particles. The development systems used for two component development can have either a rotating magnetic core, a rotating shell around a fixed magnetic core, or a rotating magnetic core and a rotating magnetic shell. It is preferred that the marking particles used in practicing this invention are toner that is a component of dry developer. Marking particles are removed from the development system when images are printed. Replacement marking particles are added to the development systems 10A-10F by replenishment stations 158, each of which contains the appropriate marking particle.

In the example shown in FIG. 1, after each development system develops the electrostatic latent image on the primary imaging member (PIM) 115, thereby converting the electrostatic latent image a visible image, each image is transferred, in register, to an intermediate transfer member (ITM) 150. The ITM can be in the form of a continuous web as shown or can take other forms such as a drum or sheet. It is preferable to use a compliant intermediate transfer member, such as described in the literature, but noncompliant ITMs can also be used.

The receiver sheets are held in the printer at a paper tray (paper source) 105 and, in the example shown, enter the paper path 106 so as to travel initially in a counterclockwise direction. The paper could also be manually input at manual input 190 from the left side of the electrophotographic engine. The printed image is transferred from the ITM to the receiver and the image bearing receiver then passes through a fuser 170 where the image is permanently fixed to the receiver. The image then enters a region where the receiver either enters an inverter 162 or continues to travel counterclockwise. If the receiver enters the inverter, it travels clockwise, stops, and then travels counterclockwise back onto the duplex path 180. This inverts the image, thereby allowing the image to be duplexed. Prior to the inverter is a diverter 152 that can divert the receiver sheet from the inverter and send it along the paper path in a counterclockwise direction. This allows multiple passes of the receiver on the simplex side, as might be desired if multiple layers of marking particles are used in the image or if special effects such as raised letter printing using large clear toner are to be used. Operation of the diverter to enable a repeat of simplex and duplex printing can be visualized using the duplex path 180 shown in FIG. 1.

It should be noted that, if desired, the fuser 170 can be disabled so as to allow a simplex image to pass through the fuser without fusing. This might be the case if an expanded color balance in simple printing is desired and a first fusing step might compromise color blending during the second pass through the EP engine. Alternatively, a fusing system that merely tacks, rather than fully fuses, an image and is known in the literature can be used if desired such as when multiple simplex images are to be produced. The image can also be sent through a subsystem that imparts a high gloss to the image, as is known in the literature and is described in commonly assigned co-owned U.S. Pat. Nos. 7,212,772; 7,324,240; 7,468,820; and 7,687,213, as well as U.S. Publication No. 2008/0159786, which are hereby incorporated by reference.

Figure 2:
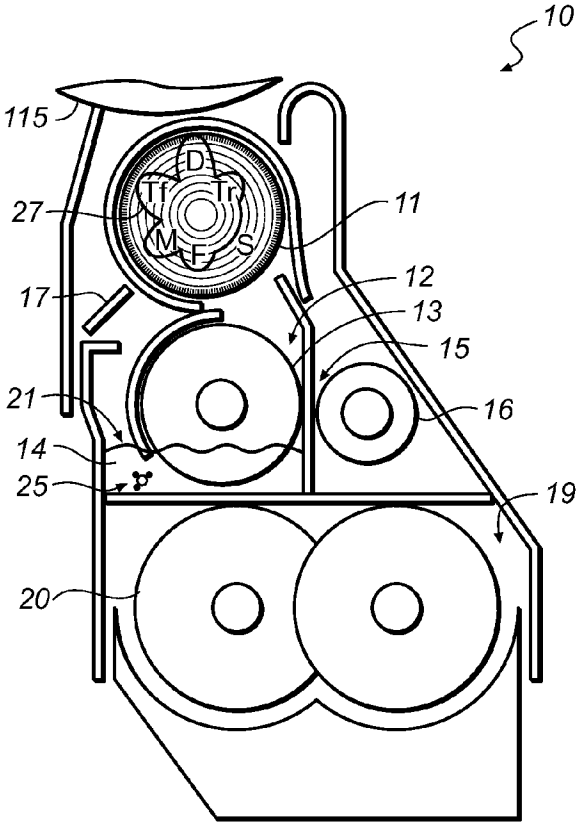
FIG. 2 is a transverse cross-sectional view of a development system for an electrophotographic printer according to an embodiment of the invention.

FIG. 2 is a transverse cross-sectional view of a development system 10 for an electrophotographic printer according to an embodiment of the invention. A development roller 11 is adjacent a feed auger 13 in a first channel 12. The cross-sectional view of FIG. 2 shows a low volume 21 of developer 14 containing magnetic particles and marking particles 25 (not to scale), with the marking particles represented schematically as a filled-in circle and the magnetic particles as an unfilled circle.

The configuration of the magnetic field 27 of the development roller 11 is shown schematically inside the development roller. The poles and regions around the development roller are labeled to denote the function that each pole performs. The material is picked up from the first channel 12 by the magnetic field associated with the feed pole F.

The correct mass of developer is metered onto the development roller by the combined action of the metering pole M, the metering skive 17, and the rotation of the development roller shell, provided that an excess of developer is delivered to the metering skive. The developer is transported into proximity to the PIM 115 by the action of the transport (feed) pole Tf and rotation of the development roller shell. The development pole D is active in the development zone where the developer is simultaneously contacting the PIM and the development roller.

The developer is then transported away from the development zone by the action of the transport (return) pole Tr and the rotation of the development roller. The developer falls into the second channel 15 where the radial magnetic field strength goes to zero in the stripping zone S. The developer is moved to the rear of the development system by second auger 16. The developer collected by the second channel 15 and the remaining developer in the first channel 12 are both dropped into the third channel 19, where at least a third auger 20 moves the developer to the front of the station, where it is fed to the first end of the feed auger 13 in the first channel 12.

Figure 3:
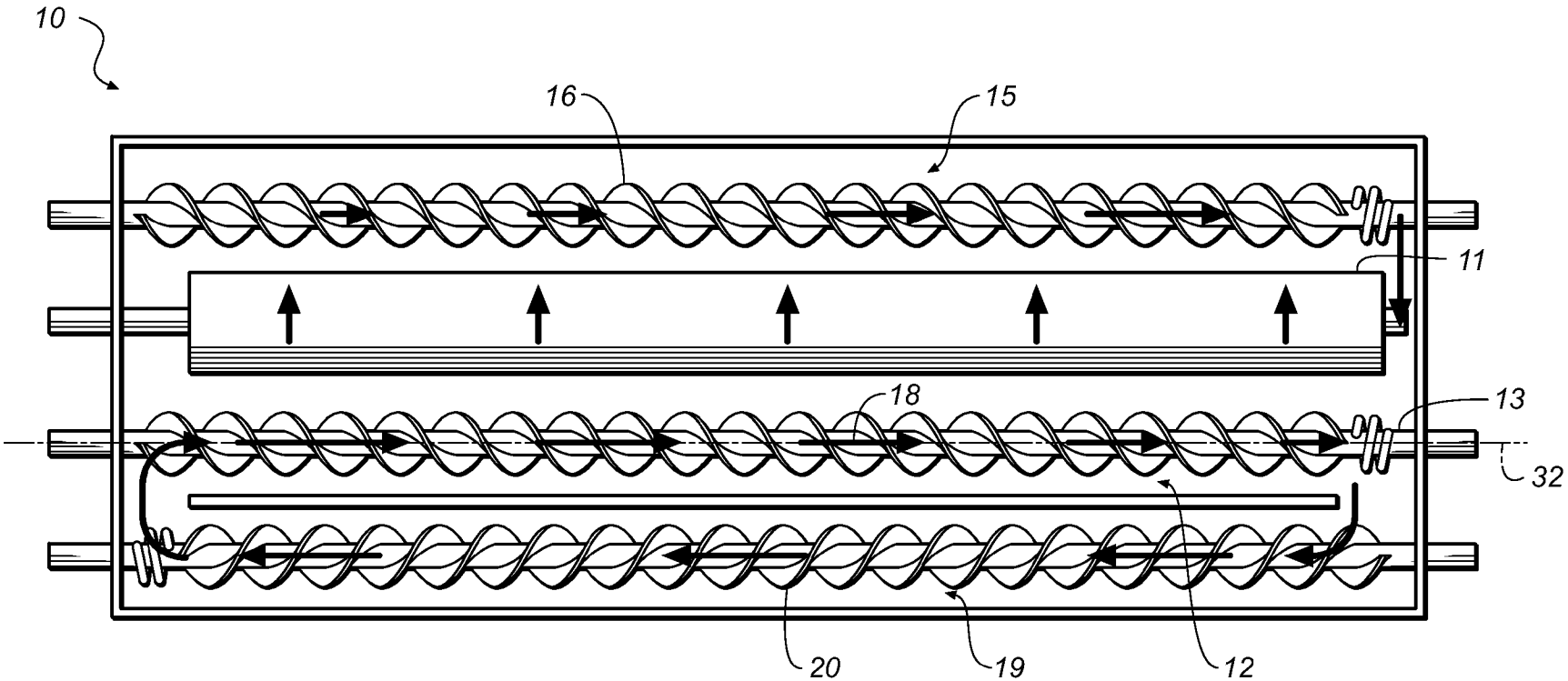
FIG. 3 is a longitudinal cross-sectional schematic view of a development system for an electrophotographic printer according to an embodiment of the invention.

FIG. 3 is a longitudinal cross-sectional schematic view of a development system for an electrophotographic printer according to an embodiment of the invention that shows a direction of developer flow 18 in the first channel 12 along an axis of the feed auger 32. The decreasing volume of developer in the first channel 12 is indicated by the decreasing length of the arrows 18 in the direction of developer flow. Uniform flow of developer over the development roller 11 is indicated by similar arrows of the same size. Increasing volume of developer in the second channel 15 is indicated by the increasing length of the arrows in the direction of developer flow. The arrows also indicate that developer from the first channel and the second channel is collected in the third channel 19, where it is mixed and fed to the first channel.

Figure 4:
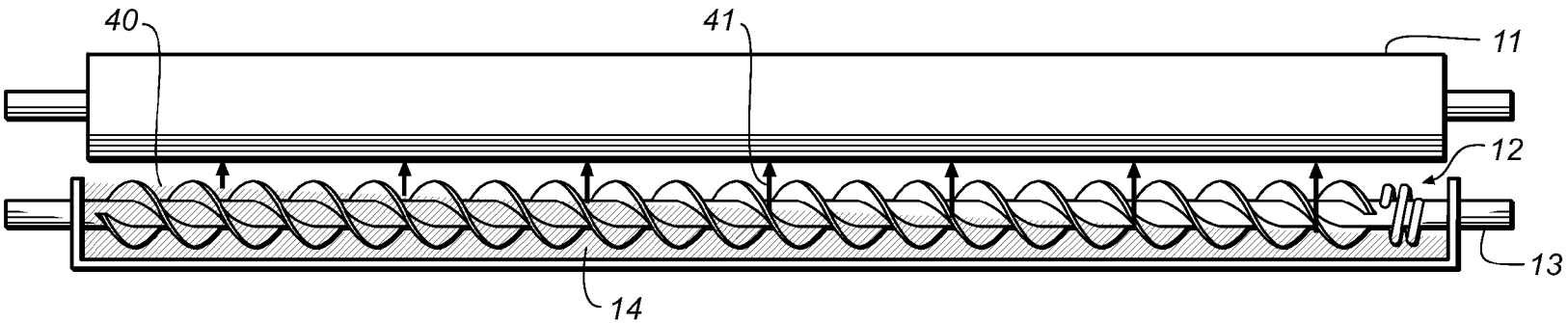
FIG. 4 is a longitudinal cross-sectional view of the development roller, the feed auger and the first channel showing the developer level in the first channel.

FIG. 4 is a perspective view of a feed auger 13 and a development roller 11 shown in longitudinal cross-section. The reduction in the volume of developer 14 in the first channel is indicated by the level of developer 40 and the shaded region in the drawing. At the first end of the first channel where the volume of developer is larger, a weaker magnetic field is sufficient to attract the required mass of developer to the development roller. The magnitude of the radial magnetic field at the feed pole position is indicated by the length of the arrows 41. As developer is transported from the first channel onto the development roller and into proximity to the PIM and then into the second channel, the volume of developer in the first channel decreases. The radial magnetic strength of the feed pole is increased down the length of the development roller to compensate for the decrease in the developer volume in the first channel. The increase in radial field strength allows sufficient developer to be picked up by the development roller as the developer level in the first channel decreases. If the magnetic field strength did not increase down the length of the development roller, the magnetic field would not be strong enough to pick up sufficient developer, as the magnetic field strength would be too low at the height of the reduced volume of developer.

Figure 5B:
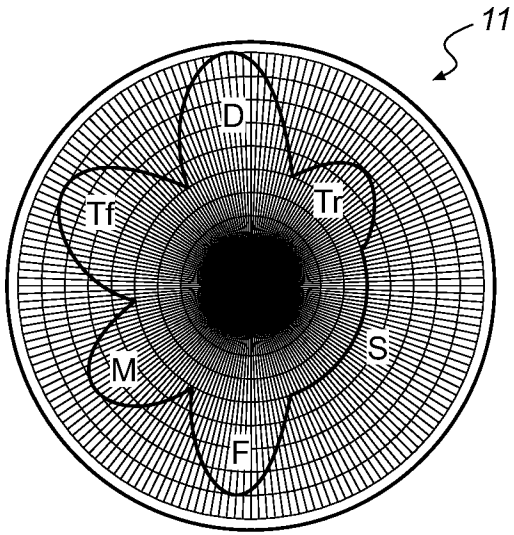
FIG. 5A and FIG. 5B are transverse cross-sectional views of the development roller showing the magnetic field strengths.
Figure 5A:
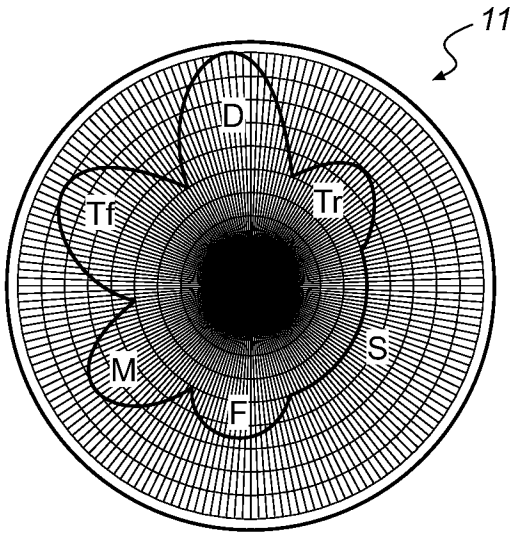

FIG. 5A and FIG. 5B are transverse cross-sectional views of the development roller 11 that show the relative radial magnetic field strengths of the feed pole (F) at the first end (front of the development station) of the development roller where the level of developer in the first channel is high (FIG. 5A) and at the second end (rear of the development station) where the level of developer in the first channel is low (FIG. 5B). The increase in radial magnetic field strength down the length of the development roller allows sufficient developer to be picked up from the first channel even though the level of developer in the first channel is decreasing from the first end to the second end.

Figure 6A:
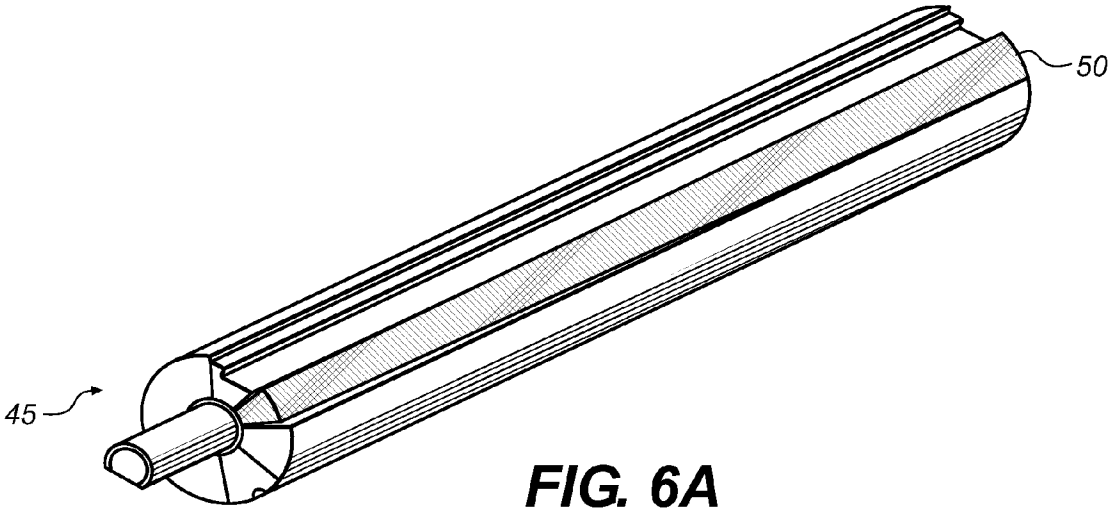
FIG. 6A is an isometric view of the development roller magnet assembly.
Figure 6B:
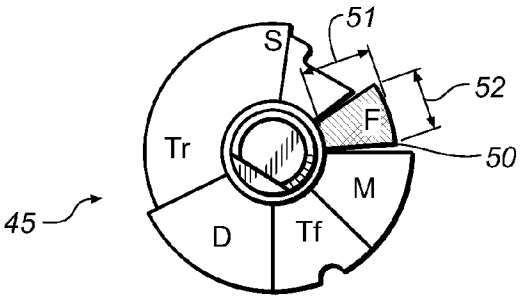
FIG. 6B is a cross-sectional view of the magnet assembly near the first end of the development roller.
Figure 6C:
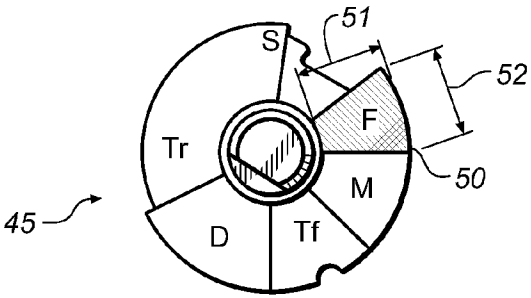
FIG. 6C is a cross-sectional view of the magnet assembly near the second end of the development roller.

There are several methods that can be used to modify the strength of the magnetic field of the development roller feed pole. If the magnetic poles of the development roller magnet assembly comprise physically discrete bar magnets, it is possible to adjust the strength of the feed pole by changing the geometry of the feed pole magnet. As shown in FIGS. 6A-6C, the height 51 and width 52 of the feed pole magnet 50 of the development roller magnet assembly 45 can increase from the first end of the development roller 11 where the developer level is high in the first channel to the second end of the development roller where the developer level is low in the first channel. FIG. 6A is an isometric view of the development roller magnet assembly 45, FIG. 6B is a cross-sectional view of the magnet assembly near the first end of the development roller and FIG. 6C is a cross-sectional view of the magnet assembly near the second end of the development roller. In this example both the height and width of the feed pole bar magnet are changed down the length of the development roller.

Figure 7A:
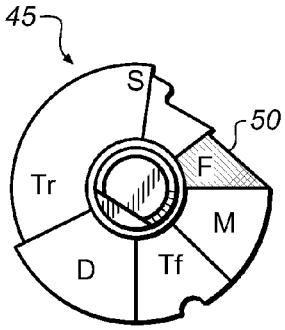
FIG. 7A is a cross-sectional view of the developer roller magnet assembly near the first end of the development roller and shows the feed pole magnet.
Figure 7B:
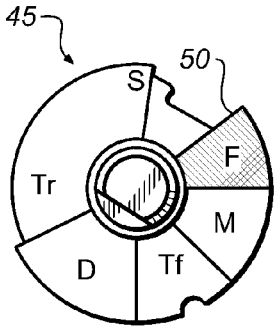
FIG. 7B is a cross-sectional view of the developer roller magnet assembly near the second end of the development roller.
Figure 7C:
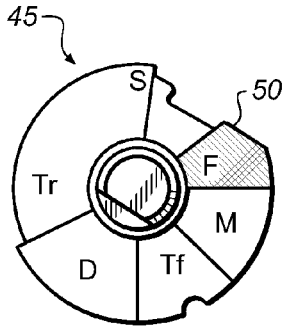
FIG. 7C shows the shape of the pole halfway down the length of the development roller.

It is possible to get the desired effect by changing only the height or the width of the feed pole magnet or by changing the geometry of the feed pole magnet in some other manner. An example of such a geometry change is shown in FIG. 7A and FIG. 7B. FIG. 7A is a cross-sectional view of the developer roller magnet assembly 45 near the first end of the development roller and shows the feed pole magnet 50 having a shape where one corner of the bar magnet has been removed. FIG. 7B is a cross-sectional view of the developer roller magnet assembly 45 near the second end of the development roller and shows the feed pole magnet 50 having the shape of an annular sector. To effect the increase in magnetic field down the length of the development roller, the feed pole magnet would smoothly transition from the largely quadrilateral shape to the annular sector shape down the length of the development roller. FIG. 7C shows the shape of the pole halfway down the length of the development roller. FIGS. 6A-6C and FIGS. 7A-7C illustrate two possible geometry configurations for the feed pole magnet that would change the feed pole magnetic field strength down the length of the development roller. Other geometry changes are certainly possible and within the scope of the invention.

Figure 8A:
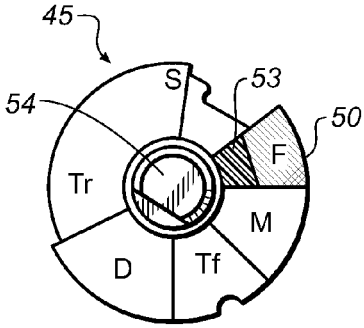
FIG. 8A and FIG. 8B are cross-sectional views of a development roller magnet assembly wherein a plastic separator separates the feed pole bar magnet from the magnetic development roller magnet assembly core.
Figure 8B:
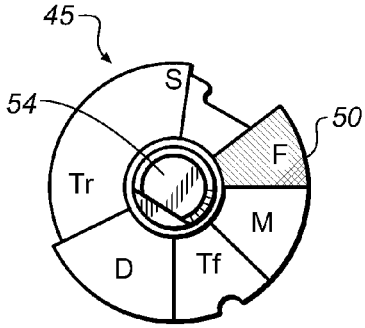

Another means of modulating the magnetic field strength of the feed pole is by changing the material and/or geometry of the core on which the bar magnets are mounted. If the core of the developer roller magnet assembly is composed of a soft magnetic material, then the strength of the feed pole can be modulated by spacing the feed pole magnet away from the developer roller magnet assembly core with a diamagnetic material such as plastic. FIG. 8A and FIG. 8B are cross-sectional views of a development roller magnet assembly where a plastic separator 53 is used to separate the feed pole bar magnet from the magnetic development roller magnet assembly core 54 with a separation that decreases from the first end of the development roller to the second end of the development roller. FIG. 8A shows a cross-sectional view of the developer roller magnet assembly 45 at the first end of the development roller and FIG. 8B shows a cross-sectional view of the developer roller magnet assembly 45 at the second end of the development roller. The plastic separator decreases in thickness from the first end of the development roller to the second end of the development roller.

Figure 9A:
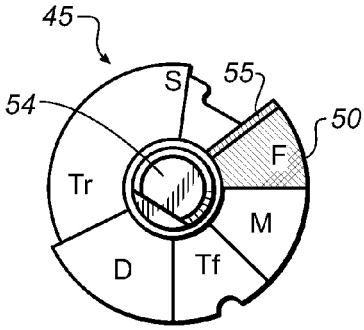
FIG. 9A and FIG. 9B show cross-sectional views of the developer roller magnet assembly where a mu-metal sheet has been added adjacent to the feed pole.
Figure 9B:
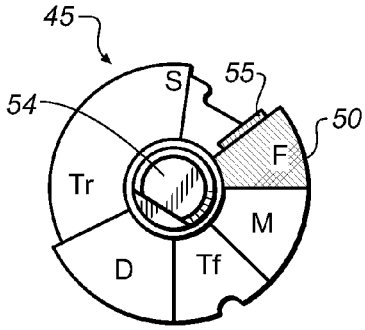

A high magnetic permeability material such as mu-metal can also be used to modulate the strength of the magnetic field of the feed pole. FIG. 9A shows a cross-sectional view of the developer roller magnet assembly 45 at the first end of the development roller where a mu-metal sheet 55 has been added adjacent to the feed pole. The mu-metal sheet will shunt the magnetic field lines of the feed pole so that they do not extend as far radially from the feed pole, thus reducing the strength of the magnetic field due to the feed pole in the first channel at the first end of the development roller. The geometry of the mu-metal sheet changes down the length of the development roller so that the magnetic field strength of the feed pole increases in the first channel from the first end of the development roller to the second end of the development roller. An example of how the geometry of the mu-metal sheet might change is shown in FIG. 9B, which is a cross-sectional view of the developer roller magnet assembly 45 approximately half way down the length of the development roller. The mu-metal sheet 55 at this position is approximately half the size of the mu-metal sheet at the first end of the development roller.

If the developer roller magnet assembly does not comprise discrete bar magnets but is instead produced from a cylinder of magnetic material that is magnetized in a pattern to produce the pole pattern, the magnetization fixture could be controlled such that the magnetic field strength of the feed pole increases from the first end of the development roller to the second end.

For either the discrete bar magnet or the continuous cylinder configuration it may be necessary to make modifications to the adjacent poles so that they retain their function as the radial magnetic field strength of the feed pole is modulated. In the example development roller shown in FIG. 2 it may be necessary to change the geometry or the magnetization level of the metering pole or the transport return pole so that those poles retain their function and the development roller assembly is capable of supplying a uniform layer of developer into proximity to the primary imaging member.

In the example shown in FIG. 2, a 5-pole design was selected to support five discrete and different functions around the development roller. Depending on functional requirements, the number of poles may be larger or smaller than the design shown. A 4-pole design is typically smaller in size and would require that two of the indicated functions are collapsed into a single function, e.g. the metering zone M and the transport feeding zone Tf might be accomplished in a single pole. The magnetic field between the 4-poles must be re-balanced by changing geometry and magnetization level of the magnetic poles to generate the desired radial field components capable of supplying a uniform layer of developer into the proximity to the primary imaging member. For the example development roller shown in FIG. 2, the field was maximized for the development zone D with intermediate fields for the transport feed zone Tf and the metering zone M and weak field in the transport return zone Tr and no field in the stripping zone S. The field in the feed zone F was varied along the lateral dimension of the development roller from a maximum to about 35% according to this invention.

The invention has been described in detail with particular reference to certain preferred embodiments thereof, but it will be understood that variations and modifications can be effected within the scope of the invention.

PARTS LIST

| | |
|---|---|
| 10 | development system |
| 10A-10F | development system |
| 11 | development roller |
| 12 | first channel |
| 13 | feed auger |
| 14 | developer |
| 15 | second channel |
| 16 | second auger |
| 17 | metering skive |
| 18 | direction of developer flow |
| 19 | third channel |
| 20 | third auger |
| 21 | low volume |
| 25 | magnetic particles and marking particles |
| 27 | magnetic field |
| 32 | axis of the feed auger |
| 40 | developer level |
| 41 | representation of radial magnetic field strength |
| 45 | developer roller magnet assembly |
| 50 | feed pole magnet |
| 51 | height of feed pole magnet |
| 52 | width of feed pole magnet |
| 53 | plastic separator |
| 54 | developer roller magnet assembly core |
| 55 | mu-metal sheet |
| 100 | electrophotographic (EP) engine or printer |
| 105 | paper source |
| 111 | receiver |
| 106 | paper path |
| 115 | primary imaging member (PIM) |
| 120A-120F | electrophotographic (EP) module |
| 150 | intermediate transfer member (ITM) |
| 152 | diverter |
| 158 | replenishment station |
| 162 | inverter |
| 170 | fuser |

-continued

| | |
|---|---|
| 180 | paper path |
| 190 | manual input |

The invention claimed is:

1. A method for transferring developer to a development roller in an electrophotographic printing process comprising:

feeding developer from a first channel to the development roller;

releasing developer from the development roller to a second channel; and wherein a strength of a pickup field of a feed magnet in the development roller increases in a direction of developer flow in the first channel.

2. The method of claim 1 wherein the first channel contains feed auger.

3. The method of claim 1 wherein the second channel containing a second auger.

4. The method of claim 1 wherein the strength of the pickup field of the feed magnet increases in the direction of developer flow in the first channel by increasing a width of the feed magnet.

5. The method of claim 1 wherein the strength of the pickup field of the feed magnet increases in the direction of developer flow in the first channel by increasing a height of the feed magnet in a radial direction.

6. The method of claim 1 wherein the strength of the pickup field of the feed magnet increases in the direction of developer flow in the first channel by increasing a strength of the feed magnet in the direction of developer flow in the first channel.

7. A method for electrophotographic printing with multiple augers comprising:

feeding developer from a first channel to a development roller trap ported across at least a portion of the development roller;

releasing developer from the development roller to a second channel or a third channel;

increasing a strength of a pickup field of a feed magnet in the development roller in a direction of developer flow in the first channel.

8. The method of claim 7 wherein the strength of the pickup field of the feed magnet is increased in the direction of developer flow in the first channel by increasing a width of the feed magnet.

9. The method of claim 7 wherein the strength of the pickup field of the feed magnet is increased in the direction of developer flow in the first channel by increasing a height of the feed magnet in a radial direction.

10. The method of claim 7 wherein the strength of the pickup field of the feed magnet is increased in the direction of developer flow in the first channel by increasing a strength of the feed magnet in the direction of developer flow in the first channel.

* * * * *